US006551730B1

(12) United States Patent
Barbezat et al.

(10) Patent No.: US 6,551,730 B1
(45) Date of Patent: Apr. 22, 2003

(54) ALUMINUM OXIDE BASED THICK LAYERS PRODUCED BY PLASMA JET SPRAYING

(75) Inventors: Gérard Barbezat, CH-Opfikon (CH); Stefan Zimmermann, D-Denkte (DE)

(73) Assignee: Sulzer Metco AG, Wohlen (SE)

( * ) Notice: Subject to any disclaimer, the term of this patent is extended or adjusted under 35 U.S.C. 154(b) by 0 days.

(21) Appl. No.: 09/632,680

(22) Filed: Aug. 7, 2000

(30) Foreign Application Priority Data

Sep. 8, 1999 (DE) ..... 199 42 857

(51) Int. Cl.[7] ..... B32B 15/04

(52) U.S. Cl. ..... 428/701; 428/702; 428/699; 428/469

(58) Field of Search ..... 428/469, 472, 428/472.2, 699, 700, 701, 702; 427/419.3, 427; 429/32

(56) References Cited

U.S. PATENT DOCUMENTS 4,402,888 A * 9/1983 Runck ..... 264/22
5,284,698 A * 2/1994 Marshall et al.
5,939,219 A * 8/1999 Jansing et al. ..... 429/32

FOREIGN PATENT DOCUMENTS

DE 19538034 1/1997

* cited by examiner

*Primary Examiner*—Deborah Jones
*Assistant Examiner*—Jennifer McNeil
(74) *Attorney, Agent, or Firm*—Tarolli, Sundheim, Covell & Tummino L.L.P.

(57) ABSTRACT

$Al_2O_3$ based layers having a total thickness of more than 0.3 mm are produced on a substrate by plasma jet spraying, said $Al_2O_3$ based layers having a laminar sandwiched structure wherein at least one $Al_2O_3$ layer is interpolated between two intermediate layers which are produced by plasma jet spraying as well, said intermediate layers consisting of a ceramic laminated material which is different from $Al_2O_3$ and which on cooling increases in volume by phase transition. Preferred materials for said intermediate layers are $Al_2O_3/ZrO_2$, $Al_2O_3/TiO_2$, $ZrO_2/Y_2O_3$, $Y_2O_3/ZrO_2$, $ZrO_2$/MgO $ZrO_2/CeO_2$ and $ZrO_2$/CaO alloy systems.

6 Claims, 1 Drawing Sheet

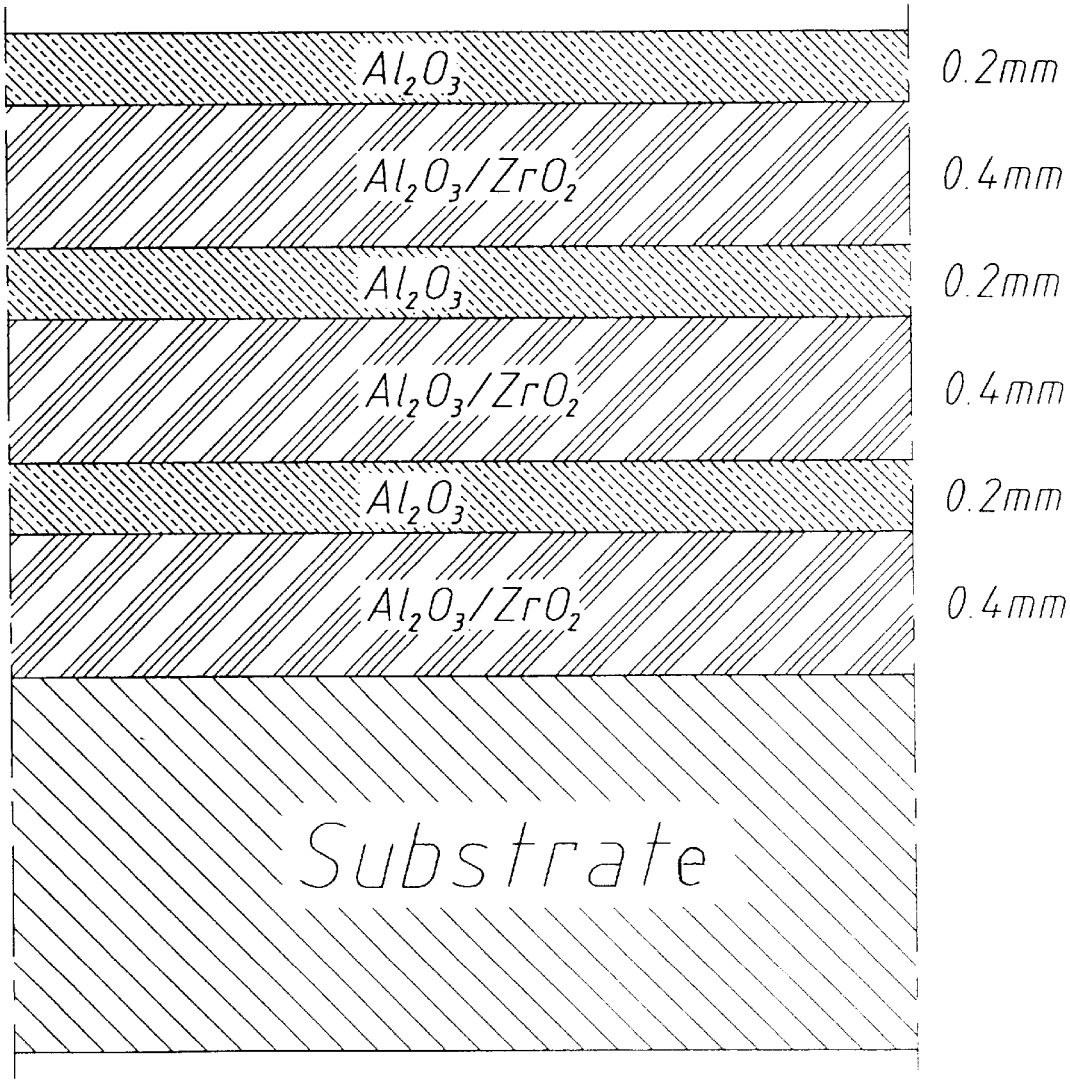
$Al_2O_3$
0.2mm
$Al_2O_3/ZrO_2$
0.4mm
$Al_2O_3$
0.2mm
$Al_2O_3/ZrO_2$
0.4mm
$Al_2O_3$
0.2mm
$Al_2O_3/ZrO_2$
0.4mm
Substrate

ALUMINUM OXIDE BASED THICK LAYERS PRODUCED BY PLASMA JET SPRAYING

FIELD OF THE INVENTION

This invention refers to $Al_2O_3$ based layers having a total thickness of more than 0.3 mm produced on a substrate by plasma jet spraying.

BACKGROUND OF THE INVENTION $Al_2O_3$ layers produced by plasma jet spraying are used in the technology of electric insulation since years.

Thus, the publication DE 195 38 034 C1 describes a high temperature fuel cell comprising at least to ceramic layers of different composition arranged one upon the other, which layers can be produced by plasma jet spraying.

This sequence of different ceramic layers has the advantage that different requirements, such as electrical insulation and the coefficient of thermal linear expansion, are performed separately by different layers. As an example, $ZrO_2$ and $Al_2O_3$ are mentioned as material for said ceramic layers.

Further, the publication U.S. Pat. No. 5,338,577 describes ceramic coated metallic substrates in which $ZrO_2$ and $Al_2O_3$ are applied successively by plasma jet spraying.

Finally, the publication U.S. Pat. No. 4,588,655 describes a powder for plasma jet spraying consisting of $Al_2O_3$ and $ZrO_2$.

Normally, a breakdown voltage of 15 kV per mm of layer is reached if no humidity is present. However, pure $Al_2O_3$ is a relatively brittle material which cannot be spread in layers having a thickness of more than 0.8 mm without incurring the risk of cracking.

OBJECTS OF THE INVENTION

It is a primary object of the present invention to produce $Al_2O_3$ based layers having a total thickness of more than 0.3 mm by plasma jet spraying, without generating macrofissures which would clearly reduce dielectric strength.

Another object of the present invention is to provide suitable alloy systems for producing said layers.

Still further objects of the invention will be evident from the following specification and claims.

SUMMARY OF THE INVENTION

The foregoing and other objects, advantages and features of the present invention can be attained by an $Al_2O_3$ based layer having a total thickness of more than 0.3 mm produced on a substrate by plasma jet spraying, said $Al_2O_3$ based layer having a laminar sandwiched structure wherein at least one $Al_2O_3$ layer is interpolated between two intermediate layers, which are produced by plasma jet spraying as well, said intermediate layers consisting of a ceramic laminated material which is different from $Al_2O_3$ and which on cooling increases in volume by phase transition.

This structure makes that the $Al_2O_3$ layers are compressed by the adjacent intermediate layers increased in volume, thus avoiding generation of macrofissures.

Preferred materials for said intermediate layers are $Al_2O_3/ZrO_2$ and $Al_2O_3/TiO_2$ alloy systems.

In a $Al_2O_3/ZrO_2$ alloy system, on crystallization by phase transition, four crystalline phases are formed, i.e. $\alpha$-$Al_2O_3$, $\gamma$-$Al_2O_3$, cubic $ZrO_2$ and monoclinic $ZrO_2$, which together occupy an increased volume as compared with the original volume immediately after spraying. Thus, the intermediate layers pressurize the adjacent $Al_2O_3$ layer. This alloy system normally comprises from 5 to 50 percent by weight, and preferably from 10 to 30 percent by weight, of $ZrO_2$.

Similar conditions prevail when using the other alloy systems mentioned above and below. Thus, in a $Al_2O_3/TiO_2$ alloy system preferably the corresponding rutiles are formed. This alloy system normally comprises from 1 to 50 percent by weight, and preferably from 5 to 18 percent by weight, of $TiO_2$.

Other alloy systems useful as intermediate layers in the present invention are e.g.:

- $ZrO_2/Y_2O_3$, preferably comprising from 8 to 22 percent by weight of $Y_2O_3$;
- $Y_2O_3/ZrO_2$, preferably from 5 to 15 percent by weight of $ZrO_2$;
- $ZrO_2/MgO$, preferably comprising from 5 to 30 percent by weight of MgO;
- $ZrO_2/CeO_2$, preferably comprising from 10 to 15 percent by weight of $CeO_2$;
- $ZrO_2/CaO$, preferably comprising from 2 to 10 percent by weight of CaO.

Preferably, the thickness of said intermediate layers is from 0.1 to 1 mm and the thickness of said $Al_2O_3$ layers is from 0.05 to 0.3 mm.

Said intermediate layers of the present invention show a greater tenacity than the $Al_2O_3$ layers. This improves the toughness of the total layer. Moreover, they are electrically insulating, thus supporting an improved dielectric strength.

The layers of the present invention may be sealed on their surface with an organic or inorganic material.

Intermediate layers of the present invention consisting of the aforementioned alloy systems, and in particular of an $Al_2O_3/ZrO_2$ aforementioned alloy system, are particularly useful for coating so-called corona rollers.

DRAWINGS

The only FIGURE of the drawings shows, by way of example, the detailed layer structure of a layer produced by plasma jet spraying having a total thickness of 1.8 mm, indicating the thickness of the individual layers.

EXAMPLE

A corona roller, made of stainless steel and having a diameter of 100 mm, was alternately coated by plasma jet spraying with layers of $Al_2O_3$ and layers of an $Al_2O_3/ZrO_2$ alloy system comprising 20 percent by weight of $ZrO_2$, beginning and terminating with a pure $Al_2O_3$ layer. The total thickness of the layer was 1.8 mm. The average thickness of each of the $Al_2O_3$ layers was 0.2 mm, and that of each of the $Al_2O_3/ZrO_2$ alloy system layers was 0.4 mm.

What is claimed is:

1. An $Al_2O_3$ based laminate having a thickness of more than 0.3 mm produced on a substrate by plasma jet spraying, said $Al_2O_3$ based laminate being exempt from macrofissure reducing the dielectric strength and having a laminar sandwiched structure wherein at least one $Al_2O_3$ layer is interpolated between two intermediate layers, which are produced by plasma jet spraying as well, said intermediate layers consisting of a ceramic laminated material which is different from $Al_2O_3$ and which on cooling increase in volume by phase transition, said intermediate layers consisting of an $Al_2O_3/ZrO_2$ alloy system comprising 5 to 50 percent by weight of $ZrO_2$.

2. An $Al_2O_3$ based laminate according to claim 1, wherein said $Al_2O_3/ZrO_2$ alloy system of said intermediate layers comprises from 10 to 30 percent by weight of $ZrO_2$.

3. An $Al_2O_3$ based laminate having a thickness of more than 0.3 mm produced on a substrate by plasma jet spraying, said $Al_2O_3$ based laminate having a laminar sandwiched structure wherein at least one $Al_2O_3$ layer is interpolated between two intermediate layers which are produced by plasma jet spraying as well, said intermediate layers consisting of a ceramic laminated material which is different from $Al_2O_3$ and which on cooling increase in volume by phase transition, said intermediate layers consisting of an $Al_2O_3/TiO_2$ alloy system.

4. An $Al_2O_3$ based laminate according to claim 3, wherein said alloy system of said intermediate layers comprises 1 to 50 percent by weight of $TiO_2$.

5. An $Al_2O_3$ based laminate according to claim 4, wherein said alloy system of said intermediate layers comprises from 5 to 18 percent by weight $TiO_2$.

6. An $Al_2O_3$ based laminate having a thickness of more than 0.3 mm produced on a substrate by plasma jet spraying, said $Al_2O_3$ based laminate having a laminar sandwiched structure wherein at least one $Al_2O_3$ layer is interpolated between two intermediate layers, which are produced by plasma jet spraying as well, said intermediate layers consisting of a ceramic laminated material which is different from $Al_2O_3$ and which on cooling increase in volume by phase transition, said intermediate layers consisting of an $Al_2O_3/Y_2O_3$ alloy system comprising from 8 to 22 percent by weight of $Y_2O_3$.

* * * * *